United States Patent [19]

Yasuda et al.

[11] Patent Number: 4,856,987

[45] Date of Patent: Aug. 15, 1989

[54] TUNNEL KILN FOR CERAMIC FIRING

[75] Inventors: Keiji Yasuda, Niwa; Kazuo Nakasako; Kazuhiro Miyahara, both of Nagoya, all of Japan

[73] Assignee: NGK Insulators, Ltd., Nagoya, Japan

[21] Appl. No.: 147,179

[22] Filed: Jan. 22, 1988

[30] Foreign Application Priority Data

Jan. 30, 1987 [JP] Japan ..... 62-11561[U]

[51] Int. Cl.[4] ..... F27B 9/02

[52] U.S. Cl. ..... 432/128; 432/133; 432/241; 432/75

[58] Field of Search ..... 432/2, 75, 128, 133, 432/135, 136, 137, 141, 144, 241

[56] References Cited

U.S. PATENT DOCUMENTS

| | | | |
|---|---|---|---|
| 1,832,818 | 11/1931 | Robertson | 432/241 |
| 2,003,450 | 6/1935 | Ladd | 432/241 |
| 2,839,283 | 6/1958 | Buckholdt | 432/241 |
| 4,240,788 | 12/1980 | Naito et al. | 432/241 |

*Primary Examiner*—Henry C. Yuen

*Attorney, Agent, or Firm*—Arnold, White & Durkee

[57] ABSTRACT

A tunnel kiln for firing ceramic shaped bodies including a preheating zone, a firing zone and a cooling zone. Arranged in the preheating zone is a recovery circuit composed of a decomposition product receiving part and a discharge port for discharging the recovered decomposition product.

4 Claims, 3 Drawing Sheets

TUNNEL KILN FOR CERAMIC FIRING

BACKGROUND OF THE INVENTION

1. Field of the Invention

This invention relates to a tunnel kiln suitable for firing ceramic shaped bodies and the like.

2. Related Art Statement

Heretofore, a tunnel kiln comprising a preheating zone for preheating a shaped body to be fired, a firing zone for sintering the shaped body and a cooling zone for cooling a fired body has been used for firing a ceramic shaped body containing a shaping assistant such as an organic resin or the like.

FIG. 5 shows a sectional view of a preheating zone of a conventional kiln, wherein the firing of the shaped body is carried out by placing a shaped body 11 to be fired on a truck 12 and transferring it inside a furnace defined by furnace wall 13 so as to pass through the preheating zone, firing zone and cooling zone. In FIG. 5, an atmosphere gas heated by means of a combustion burner or the like (not shown) is discharged into the exterior of the kiln through an atmosphere gas outlet 14 arranged in the furnace wall 13 by means of a blower 15, while a sand seal 16 is arranged adjacent a lower portion of the furnace wall 13 to provided a seal between the atmosphere inside the furnace and the wheel of the truck.

In the preheating zone of the tunnel kiln of the above structure, however, the shaping assistant included in the shaped body is decomposed by heating in the preheating or firing of the shaped body to produce a decomposition product 17 of the shaping assistant (hereinafter referred to as a decomposition product).

This decomposition product 17 is initially in the form of a gas or mist but is cooled while approaching the atmosphere gas outlet 14 together with the atmosphere gas to form a liquid and further cooled to form a solid, if possible, which adheres to the inner wall of the furnace or the atmosphere gas outlet.

As the adhesion of the decomposition product 17 occurs, clogging of the atmosphere gas outlet 14 results, or the decomposition product 17 descending downward from the furnace wall 13 by its dead-weight flows into the sand seal 16 partitioning between the inside of the furnace and the wheel of the truck, whereby granular sands are bonded to each other through the decomposition product in the form of agglomerates or dumplings to lower the sand seal effect. Consequently it is feared that of exposing the wheel portion of the truck will be exposed to high temperatures or the like. Furthermore, these agglomerates or dumplings go from gaps between iron plates for sand seal into the vicinity of rails for the truck, and finally the derailment of the truck or the damage of the wheel may be caused.

Therefore, a great labor has been taken for removing the decomposition product 17 adhered to the furnace wall 13 and the atmosphere gas outlet 14.

SUMMARY OF THE INVENTION

It is, therefore, an object of the invention to provide a tunnel kiln having a structure capable of easily recovering liquid decomposition product for solving the aforementioned problems.

According to the invention, there is the provision of a tunnel kiln for ceramic firing, comprising a preheating zone for preheating a ceramic shaped body containing a shaping assistant, a firing zone for sintering the shaped body and a cooling zone for cooling the resulting sintered body, characterized in that a recovery circuit composed of a decomposition product receiving part for recovering a decomposition product of the shaping assistant and a discharge port for discharging the recovered decomposition product to the outside of the tunnel kiln is arranged in the preheating zone.

In the tunnel kiln of the above structure, tar-like or mist-like decomposition products adhered to the furnace wall or the atmosphere gas outlet wall is recovered by the decomposition product receiving part at a position that the decomposition product descends downward along the wall by its dead-weight and is then discharged outside the furnace through the discharge port, so that the adverse influence of the decomposition product at the preheating zone can be eliminated. Particularly, the flowing of the decomposition product into the sand seal is prevented without damaging the sealing effect.

BRIEF DESCRIPTION OF THE DRAWINGS

The invention will be described with reference to the accompanying drawings, wherein.

Throughout FIGS. 1–4, the same numeral represents the same member.

DESCRIPTION OF THE PREFERRED EMBODIMENTS

Figure 1:
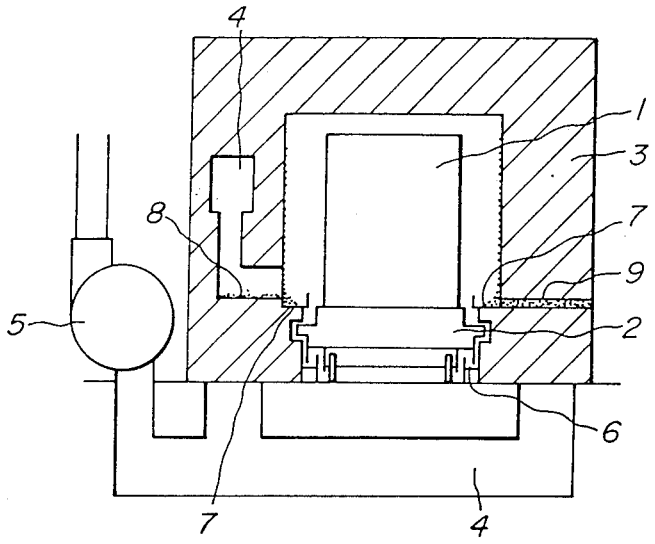
FIGS. 1 to 4 are sectional views of various embodiments of the preheating zone in the tunnel kiln according to the invention.

FIG. 1 is a sectional view of a first embodiment of the preheating zone in the tunnel kiln according to the invention. In this embodiment, a shaped body 1 to be fired is placed on a truck 2 and transferred inside a furnace defined by a furnace wall 3 to pass through a preheating zone, firing zone and cooling zone to thereby perform the firing of the shaped body 1 likewise the case of the conventional kiln. Furthermore, an atmosphere gas heated by a combination burner or the like (not shown) is discharged outside through an atmosphere gas outlet 4 arranged in the furnace wall 3 by means of a blower 5, while a sand seal 6 is disposed at the lower portion of the furnace wall 3 near thereto to seal between the atmosphere inside the furnace and the wheel of the truck 2.

In this embodiment, a pair of trough-like decomposition product receiving parts 7 are arranged at both sides of the lower portion of the furnace wall 3 over a whole of the preheating zone in its longitudinal direction, whereby tar-like or mist-like decomposition product 8 produced in the removal of the shaping assistant from the shaped body 1 and adhered to the furnace wall 3 is recovered when the adhered decomposition product descends downward due to its dead-weight. Therefore, the decomposition product 8 does not descent downward below the decomposition product receiving part 7, so that the flowing of the decomposition product 8 into the sand seal 6, which is a problem in the conventional kiln, can be eliminated to effectively seal the atmosphere inside the furnace through the sand seal 6. Furthermore, plural discharge ports 9 for the decomposition product receiving part 7 are arranged in the furnace wall 3, whereby the decomposition product 8 recovered in the decomposition product receiving part 7 can be discharged outside through the discharge ports 9. That is, a recovery circuit for the decomposition product is composed of the decomposition product receiving part 7 and the discharge ports 9.

Figure 2:
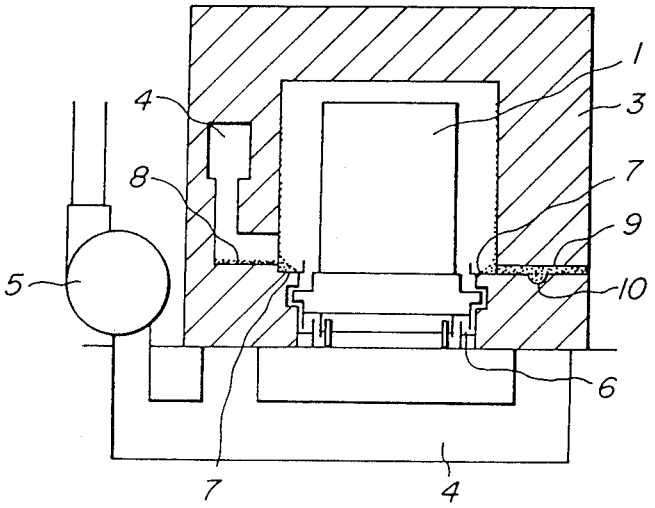

FIG. 2 is a sectional view of a second embodiment of the preheating zone in the tunnel kiln according to the invention. In this embodiment, the details of the same member as described above are omitted. This embodiment is different from the embodiment of FIG. 1 in a point that a gathering portion 10 for temporarily reserving the decomposition product is arranged in the discharge port 9. since the decomposition product 8 can temporarily be reserved in the gathering portion 10, the interval for maintenance can be prolonged.

Figure 3:
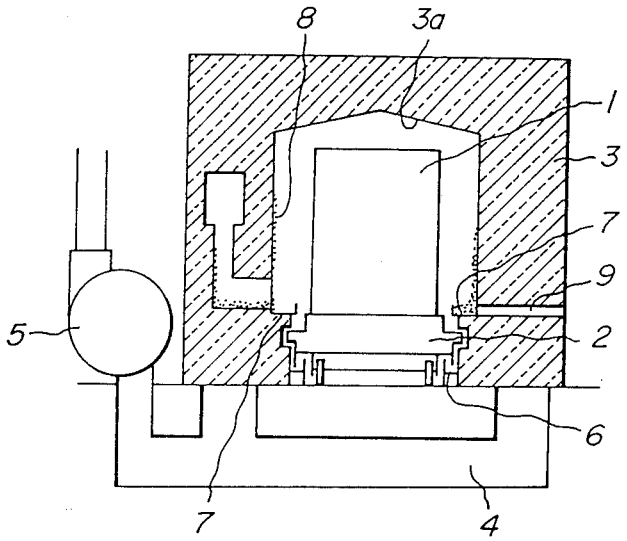

FIG. 3 is a sectional view of a third embodiment of the preheating zone in the tunnel kiln according to the invention. In this embodiment, the ceiling portion of the preheating zone is different from those of FIGS. 1 and 2 in the structure. That is, the ceiling portion 3*a* of the preheating zone is slanted downward towards the furnace wall as a side wall. This inclination may be arch-like in addition to the flat form as shown in FIG. 3. In this embodiment, the decomposition product of the shaping assistant aggregated and adhered to the ceiling portion in the preheating zone easily flows toward the furnace side wall, so that the decomposition product can more easily be recovered.

Figure 4:
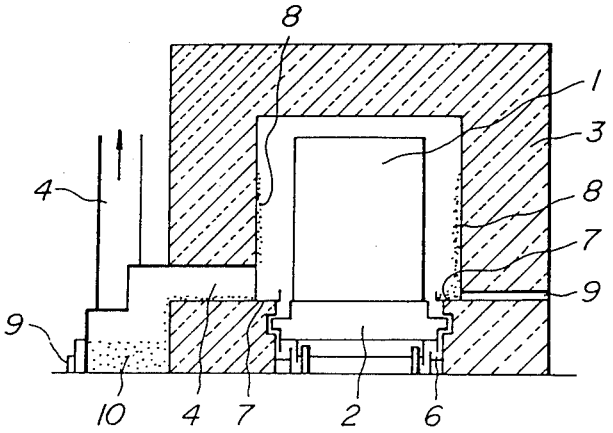
Figure 5:
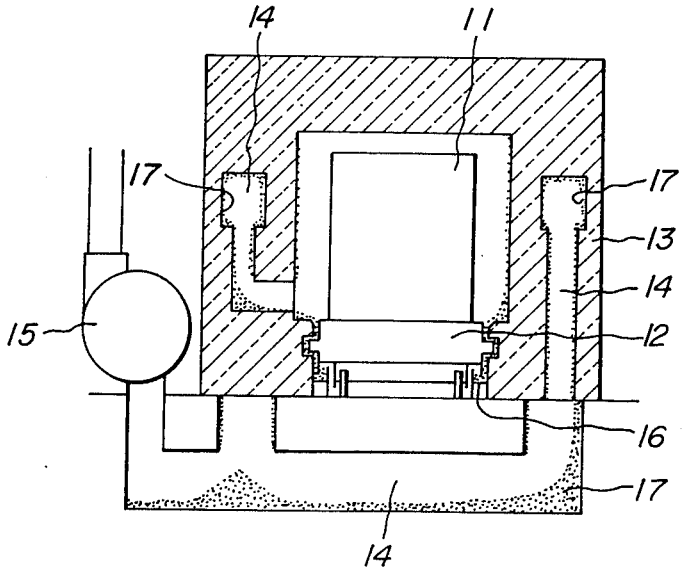
FIG. 5 PRIOR ART
FIG. 5 is a sectional view of an embodiment of the preheating zone in the conventional tunnel kiln.

FIG. 4 is a sectional view of a fourth embodiment of the preheating zone in the tunnel kiln according to the invention, wherein a part of the recovery circuit for the decomposition product 8 cooperates with the atmosphere gas outlet 4. Stated differently, a part of the discharge port 9 formed in the furnace wall serves as an atmosphere gas outlet 4 and a gathering portion 10 for the decomposition product 8 is arranged in this atmosphere gas outlet 4. By arranging a plurality of such recovery circuits serving as the atmosphere gas outlet, it is possible to eliminate the conventional known trouble of concentrically clogging the atmosphere gas outlet with the decomposition product. Further, the viscosity of the decomposition product becomes small by the preheating of the atmosphere gas to enhance the fluidity of the decomposition product and recovery thereof becomes easy.

The invention is not limited to only the above embodiments and may take various modifications and changes. For example, the trough-like decomposition product receiving part is arranged near to the lower portion of the furnace wall in the above embodiments, but the position, number and form of the receiving part are not particularly restricted. For example, such receiving parts may be arranged at any position below a position at which the decomposition product easily egglomerates.

Furthermore, in order to improve the flow of the decomposition product until the decomposition product adhered to the furnace wall 3 or the atmosphere gas outlet 4 is recovered in the trough-like receiving part 7 with descending downward through its dead-weight and discharged from the discharge port 9, the recovery circuit may be inclined so that the height of the discharge port is lower than that of the receiving part.

As mentioned above, in the tunnel kiln according to the invention, the decomposition product produced in the preheating zone is recovered in the decomposition product receiving part and then discharge outside of the furnace through the discharge port, so that the adverse influence of tar-like or mist-like decomposition product can be eliminated. As a result fired articles having good properties can easily be obtained.

What is claimed is:

1. A tunnel kiln for firing ceramic articles, said tunnel kiln comprising:
   - a preheating zone for preheating a shaped ceramic body containing a shaping assistant;
   - a firing zone for sintering the shaped ceramic body;
   - a cooling zone for cooling the resulting sintered body; and
   - a recovery circuit arranged in said pre-heating zone for recovering a decomposition product of said shaping assistant which initially adheres to inner side walls of said tunnel kiln and subsequently falls along said walls in a gravitationally downward direction therefrom, said recovery circuit comprising a decomposition product receiving part for recovering said decomposition product and a discharge port in direct communication with said receiving part for discharging the recovered decomposition product from the tunnel kiln;
   - wherein said recovery circuit includes means for preventing the decomposition product from falling below the level of the decomposition product receiving part.

2. A tunnel kiln according to claim 1, wherein said recovery circuit further includes a gathering portion for temporarily holding said decomposition product.

3. A tunnel kiln according to claim 1, wherein said preheating zone further includes a ceiling portion which is downwardly slanted towards said inner side walls of said tunnel kiln.

4. A tunnel kiln according to claim 1, wherein said discharge port of said recovery circuit further provides an atmosphere gas outlet between an inner portion of said tunnel kiln and an outer portion thereof.

* * * * *